United States Patent [19]

Sears et al.

[11] 4,015,559

[45] Apr. 5, 1977

[54] APPARATUS FOR COATING CONTINUOUSLY PRODUCED FILAMENTS

[75] Inventors: James H. Sears; James Newton Holloway, Jr., both of Anderson, S.C.

[73] Assignee: Owens-Corning Fiberglas Corporation, Toledo, Ohio

[22] Filed: Jan. 13, 1975

[21] Appl. No.: 540,738

[52] U.S. Cl. ..... 118/259; 118/234; 118/DIG. 20

[51] Int. Cl.[2] ..... B05C 1/08

[58] Field of Search ..... 118/234, DIG. 20, 258, 118/259, 261, 203; 65/11 W; 101/364

[56] References Cited

UNITED STATES PATENTS

| | | | |
|---|---|---|---|
| 1,433,976 | 10/1922 | Weightman et al. | 118/203 |
| 2,157,874 | 5/1939 | Webb | 118/261 X |
| 2,329,027 | 9/1943 | Almy | 118/234 X |
| 2,835,221 | 5/1958 | Slayter et al. | 118/DIG. 20 |
| 2,918,393 | 12/1959 | Wommack et al. | 118/259 X |
| 3,150,002 | 9/1964 | Justus | 101/364 X |
| 3,288,107 | 11/1966 | Conrad | 118/234 |
| 3,498,263 | 3/1970 | DeToledo et al. | 118/234 |
| 3,552,354 | 1/1971 | Kershaw | 118/234 |

*Primary Examiner*—John P. McIntosh
*Attorney, Agent, or Firm*—John W. Overman; Ronald C. Hudgens; Charles R. Schaub

[57] ABSTRACT

Apparatus for applying liquid to filaments that are advanced at high speeds having an open topped container for holding the liquid that is to be applied to the filaments. A rotatable applicator member located so as to transfer liquid from the container to the filaments passed across the member. The member being mounted so that a portion of its axial surface is immediately adjacent the upper edge of the open topped container on the side of filament travel. Means for moving the container with respect to the member so as to modify the spaced relationship between the upper edge and the axial surface to keep a spacing sufficiently close to discourage disruptive air flow into the container from air movement caused by high speed filament travel.

10 Claims, 8 Drawing Figures

APPARATUS FOR COATING CONTINUOUSLY PRODUCED FILAMENTS

BACKGROUND OF THE INVENTION

The present invention relates to the application of coating or sizing material to fibers. The sizing material is usually of the type applied to fibers that are to be used as a reinforcement. The apparatus of this invention applies the sizing to glass filaments at forming.

The technology which has been developed for the production of glass fibers, presently makes possible the production of fibers having a diameter of from approximately 0.0001 inch to approximately 0.0004 inch, at a rate of from approximately 4,000 feet per minute to approximately 15,000 feet per minute. Glass fibers are produced from small streams of molten glass which exude through tiny orifices located in what is called a forming position. The tiny steams of molten glass which issue from the bushing are attenuated by pulling the fibers until the diameters given above result, and during which time the streams cool and rigidify into what are called filaments. These filaments are then coated with a protective film for the purpose of preventing glass to glass abrasion, and following which they are brought together to form a strand. This strand is coiled upon a tube to form a package. During formation of the package, the strand is traversed back and forth across the tube by a device which is called a traverse, and which is located between the point where the coating materials are applied, and the rotating tube on which the package is made. The tube is rotated by what is called a collet, and the pulling action supplied by the collet attenuates the molten streams of glass, pulls the filaments past the coating applicator, and through the traverse, and coils the strand onto the package. The winder is usually located approximately 10 feet from the bushing, so that the entire forming operation is carried out in a fraction of a second.

The problem of abrasion of glass upon glass is a serious one and has generally been a controlling factor in the rate at which this technology has developed. The seriousness of this problem has caused the wide spread theory that glass on glass abrasion can only be prevented by a solid film of material between the filaments to at all times assure physical separation of the filaments. The coating on the filaments is usually as a liquid during the filament forming operation.

Roll type applicators have been used frequently in the past to coat filaments to protect them from glass upon glass abrasion. The applicator has a rotating roll that is patially submerged in coating material that is held in a container positioned below the roll. As the roll rotates it keeps picking up a fresh supply of coating liquid from the container. This liquid is carried on the roll until it is removed by filaments that pass across the roll. As the filaments remove the liquid they become coated with the liquid. This is a continuous process that does a good job of coating the filaments.

When filaments that are formed at high speeds are being coated the relationship between the liquid container and the applicator roll must be carefully controlled. This is because a great deal of air may be carried along with the filaments and this air can find its way into the liquid container. The air can cause turbulence in the liquid and can even blow the liquid out of the container. This of course greatly disrupts the coating operation and can waste a great deal of coating liquid.

To control the air problem it has been customary to design the applicator so that there is a very small space between the roll and the liquid container, on the filament coating side of the applicator. The small space allows the applicator to rotate but helps to keep air from entering into the liquid container.

The problem with this solution to the air problem is that the filaments usually wear grooves in the applicator roll. When this happens the roll must be removed and machined until it is smooth again so that it will properly coat the filaments. However, the machining removes material from the roll and the roll cannot be machined too many times before it becomes considerably smaller than its original dimension. As the roll gets smaller from machining the space between the roll and the liquid container gets larger. After the roll has been machined a few times the space becomes so large that it no longer will help to prevent the air carried with the filaments from entering into the liquid container. When this happens the old stationary roll must be removed and replaced with a new roll. The old roll is no longer suitable for use even though there is a lot of useable material left on the roll.

This type of applicator is expensive to operate because it requires the rolls to be replaced so frequently and such a small portion of the roll is used. This type of applicator also has no provision for using different size applicator rolls in the coating process.

SUMMARY OF THE INVENTION

An object of the invention is to improve the useful life of applicator rolls used in a filament coating applicator.

Another object of the invention is an improved filament coating applicator where the relationship between the applicator roll and the liquid container is variable.

Yet another object of this invention is to reduce the mess and waste associated with fiber coating applicators.

Still another object of the invention is a filament coating applicator that can use coating rolls of varying diameter.

In a broad sense these and other objects of the invention are attained by apparatus having applicator with a movable container for holding the coating liquid. The container can then be moved so that the space between the applicator roll and the liquid container will be of a size that helps to prevent disruptive entrained air from entering the liquid container. The movable liquid container allows for a substantial change in diameter of the roll without making it necessary to change the roll.

Other objects and advantages of the invention will become apparent as the invention is described hereinafter in more detail with reference made to the accompanying drawings.

DESCRIPTION OF THE PREFERRED EMBODIMENTS

The apparatus of the invention is particularly useful in processes for forming filaments of heat-softened mineral material such as molten glass. In these processes apparatus a liquid coating or sizing material is applied to individual glass filaments and the glass filaments combined into an untwisted filament bundle or glass strand that is wound onto a package. But the apparatus of the invention is useful in other processes that treat other types of linear material (for example, filament bundles such as yarn, cord, roving etc. as well as monofilaments) made from glass or other filament forming material such as nylon or polyester. Thus, the disclosure of treating and packaging glass strand in a glass filament forming operation is only an example to explain the operation of the invention. And the term filaments used in the specification and claims includes monofilaments and filament bundles, including bundles of continuous or discontinuous synthetic filaments with or without twist, in addition to bundles of natural filaments.

Figure 1:
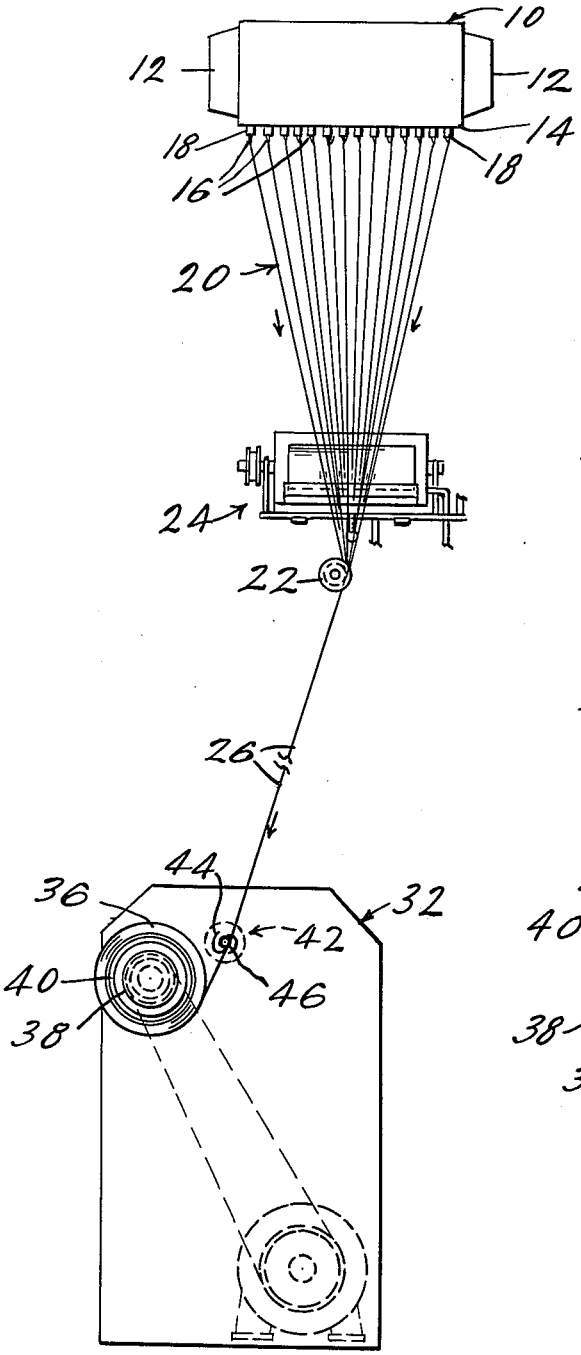
FIG. 1 is a front view of a filament coating applicator in operation during fiber forming.
Figure 2:
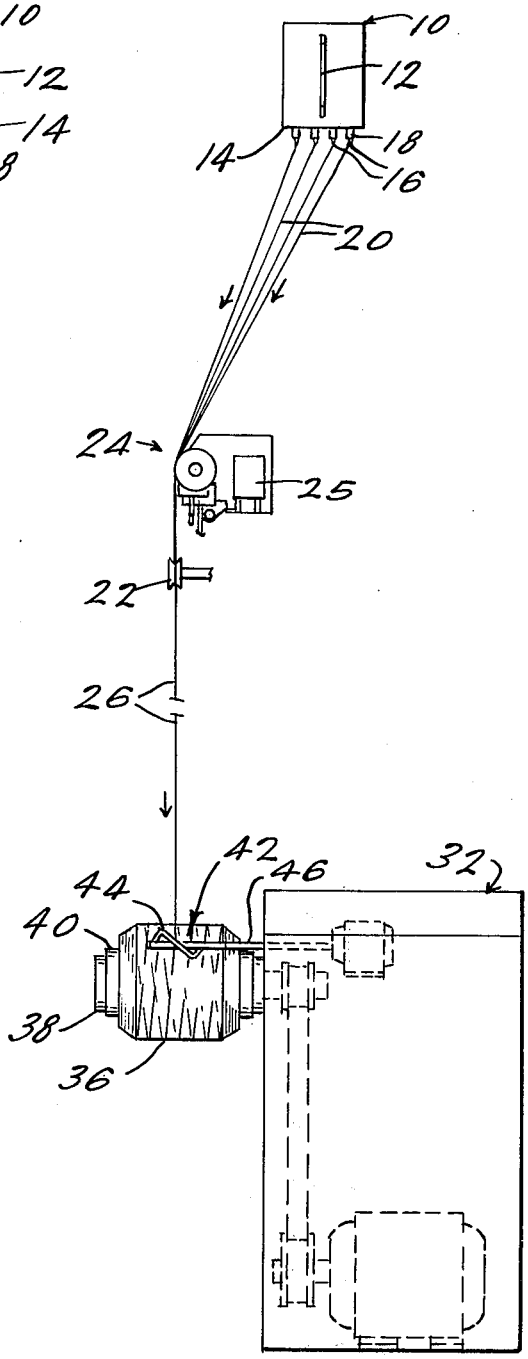
FIG. 2 is a side view of a filament coating applicator in operating during fiber forming.

FIG. 1 and 2 show a process of forming continuous glass filaments. The glass filaments 20 are passed over an applicator 25 that deposits a liquid sizing material on the filaments. The filaments 20 are then combined into an untwisted filament bundle or strand 26 that collects as a wound package 36. As illustrated, a container 10 holds a supply of molten glass. The container 10 may connect a forehearth that supplies molten glass from a furnace. A melter for reducing marbles to a heat-softened condition may also be associated with the container as a source of molten glass. Terminals 12 on the end of the container 10 are connected to a source of electrical energy. This energy is used to supply conventional resistance heating to the glass held in the container 10. The supply of heat is necessary to maintain the glass at proper fiber forming temperatures and viscosities.

The container 10 has orifices or passageways in its bottom wall 14, for delivering streams of molten glass. As shown in FIG. 1 the opening in the bottom wall 14 comprises rows of spaced apart depending orificed projections or tubular members 18.

The molten streams 16 are attenuated into individual spaced apart continuous glass filaments 20. The filaments advance downwardly together at high linear speed along converging paths. An applicator 24 is positioned along the paths of filament travel to apply a liquid sizing material to the individual filaments 20. The paths of the filaments 20 converge at the gathering member 22 to from a strand 26.

A winder 32 collects the treated strand 26 as a wound package 36 on a driven rotatable collet or mandrel 38. The package 36 forms on a collector such as a tube 40 telescoped onto the collet 38.

The pulling force of the winder attenuates the glass streams 16 into continuous glass filaments 20.

Strand traversing apparatus 42 moves the advancing strand 26 back and forth axially on the package 36 to distribute the strand 26. In the embodiment shown the traversing apparatus 42 includes a "spiral wire" 44 on a driven shaft 46. U.S. Pat. No. 2,391,870 describes the operation of a "spiral wire" traverse arrangement.

The movement of the filaments 20 draw a considerable amount of air with them from the surrounding atmosphere. The arrows in FIGS. 1 and 2 generally indicate the air flow direction.

Figure 3:
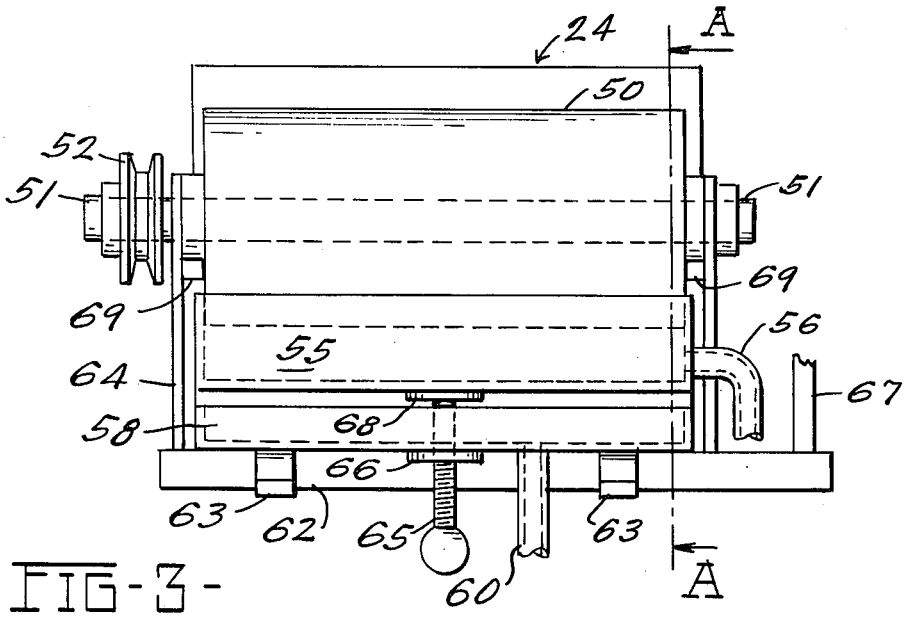
FIG. 3 is a detailed front view of a filament coating applictor.
Figure 4:
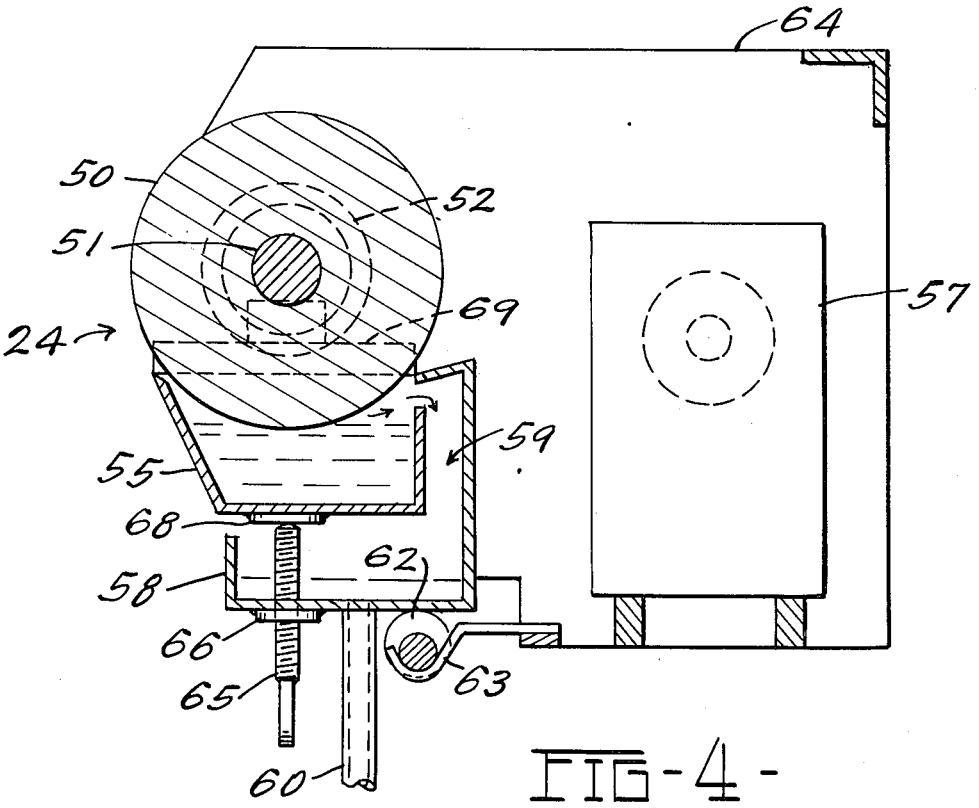
FIG. 4 is a cross section of a filament coating applicator taken along line AA shown in FIG. 3.

The applicator 24 for applying liquid sizing material to the filaments 20 is more clearly shown in FIGS. 3 and 4. The applicator 24 has a roll 50 supported on rod 51 for applying liquid to filaments passed thereacross. The roll 50 is usually made of graphite and is positioned so that a portion of the roll is located within supply or storage container 55. The container 55 holds the liquid that is to be applied to the filaments 20. The roll 50 is positioned so that when it rotates it picks up liquid material that is in container 55. This builds up a layer of liquid on the roll 50 that is later removed by the filaments 20 that pass across the roll. On one end of the support rod 51 there is a pulley 52 that is connected to motor 57 by a belt (not shown). The motor 57 supplies the power to rotate the roll 50 so it can carry liquid from the container 55 to the filaments 20. The motor 57 can rotate the roll 50 either in the direction of filament travel across the roll 50 or in a direction opposite to the direction of filament travel across the roll 50. It is also possible not to use a drive system for the roll 50 as the filaments 20 will to some extent rotate the roll 50 as they pass thereacross. However, it is believed to be preferable to have drive means for rotating the roll 50.

Liquid is supplied to the container 55 by passageway 56. The liquid is supplied to passageway 56 from a reservoir by a positive displacement pump or other suitable pumping means (not shown). The liquid material applied to the filaments is usually a sizing material. In practice it has been found that the applicator works very well when using sizing liquids that are for filaments that are to be used as reinforcements.

Immediately below the supply or storage container 55 is another container 58. This container acts as an overflow reservoir for any excess liquid that might be pumped into the supply container 55 though passageway 56. The excess liquid in container 55 goes into container 58 through passageway 59 that extends along the back edge of container 55. It is necessary to have the overflow container for the applicator so that excess liquid does not overflow the container 55 and so that there is a uniform amount of liquid applied to the roll 50.

Excess liquid in container 58 is recirculated so it can be reused by the applicator 24. This is accomplished by having the liquid pass though passageway 60 located in the bottom of container 58. Passageway 60 carries the liquid back to the pumping area where it is again pumped through passageway 56 to container 55. Thus, the liquid supplied to the applicator is kept in the system until it is picked up by the roll 50 and used to coat the filaments 20.

The container 58 is held in position by a cam lock system. The cam lock system has an excentric cam 62 that is positioned beneath the container 58. The cam is held in place by brackets 63 that allow the cam to rotate. The brackets 63 are secured in the support frame 64 that supports the applicator 24. The container 58 is placed in position on the application over the cam 62. The excentric cam 62 is rotated by handle 67 so that the excentric cam comes into contact with the container 58 and secured it in that position.

The cam lock system provides a very simple way for positioning the container 58. It also allows the container 58 to be removed very easily with no alignment problem when it is put back in position. Of course a number of other suitable methods could be used to secure the container 58 and would be acceptable.

The container 55 is then located by a screw 65 that passes through container 58 and is in contact with the bottom of container 55. There is a threaded support plate 66 on the bottom of container 58 that the screw 65 is passed through. The threaded support plate 66 and the bottom of the container 58 acts to locate and support the screw 65. The screw 65 is then supported so that it in turn can be used to locate and secure container 55. The container 55 has a support plate 68 that the end of the screw 65 rest upon.

There are also guide strips 69 that are connected to support frame 64. The guide strips 69 are positioned so that the ends of container 55 will rest against the guide strips when the container is in proper position. The ends of the container 55 are parallel and the same height as the front edge of the container. Thus, the guide strips 69 and the screw 65 act to hold the container 55 steady and in good alignment during the coating operation.

Figure 5:
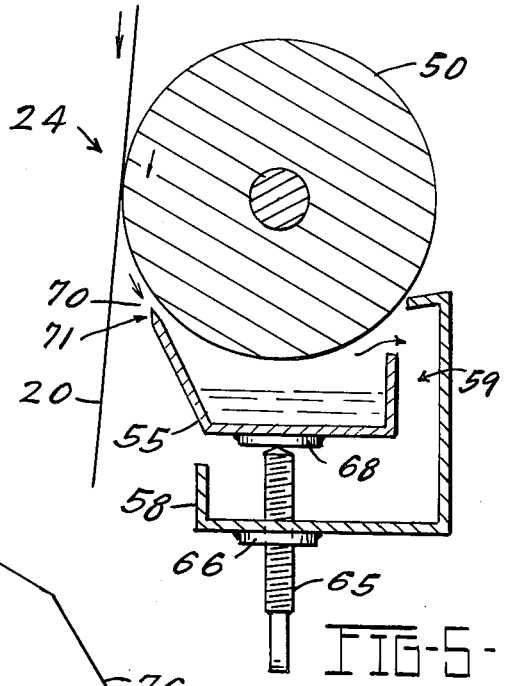
FIG. 5 is a detailed side view of an applicator, with the guide strip for the liquid container removed, where the applicator is in operation coating filaments.

In FIG. 5 the relationship between the roll 50, the container 55 and the filaments 20 is more clearly shown. Here it is seen that the air traveling with the filaments 20 (as shown by the arrows) can follow around on the roll 50. This causes problems as this air is moving at very high speeds and can be quite disruptive to the filament coating operation.

When the air flow flows around on the roll 50 it can enter into the storage or supply container 55. When the air gets into the container 55 it disrupts the liquid in the container. The air is moving at such high speeds that it creates a great deal of turbulence in the liquid. In fact the air can even blow this liquid out of the container 55. This results in a mess in the liquid coating area and wastes a great deal of the coating liquid.

Also the air, carried by the advancing filaments, that flows into container 55 can get trapped in the liquid as it is picked up by the rotating roll 50. This can create bubbles of air in the liquid on the surface of the roll 50. If the filaments 20 are drawn across the roll 50 in an area where there are air bubbles in the liquid the filaments will not be coated with liquid. When this happens there are bare spots on the filaments and glass upon glass abrasion becomes a problem.

In addition the turbulence in the liquid can create a condition where liquid is not evenly applied to the applicator roll 0. This is because there is not a calm reservoir of liquid for the roll 50 to come in contact with. Instead there is a turbulent area of liquid that does not apply an even and uniform coating of liquid on the rotating roll 50. Then when the liquid coated roll 50 is rotated into a position where it coats the filaments 20 there is an uneven coating of liquid applied to the filaments. When this happens bare spots and lumps of excess liquid can result on the filaments. This is not a very efficient method of coating the filaments and bare spots can even cause filament breakage.

Therefore, if at all possible most of the air traveling with filaments 20 should be kept out of the container 55 to maximize the coating efficiency of the applicator.

The space 70 between the roll 50 and the upper edge *1* of the container 55 is a very important feature in keeping air traveling with the filaments from entering into the container 55. When the space 70 is of an appropriate size the upper edge 71 acts as an air barrier that diverts air traveling with the filaments 20 from entering through space 70 into container 55. The edge 71 can also act as a scrapper and guard to keep foreign matter from passing through space 70 into container 55. In practice it has been found that when the space 70 is between 1/32 and 3/64 of an inch that the edge 71 function properly. Thus, it is important that the roll 50 and the container 55 be positioned so that the space 70 and the edge 71 function properly.

Maintaining the proper dimension on space 70 is a problem because the filaments 20 wear down the surface of the roll 50 over a period of time. The filaments 20 tend to make small grooves where they have passed over the roll. The grooves can cause difficulties in obtaining a uniform coating of the filaments. Therefore, it is standard practice to remove the roll 50 and machine it until the grooves are removed and the roll is smooth. However, the machining removes metal from the roll 50 and makes it smaller. When the roll 50 becomes smaller it effects the size of the space 70 between the roll 50 and the container 55. Because of the critical size limitations on the size of the space 70 not much material can be removed from the roll 50. It too much material is removed air will enter the container through space 70 and causes turbulence in the liquid.

In the past once the maximum amount of material had been removed from the roll 50 it could not be machined to take out additional grooves that might form. If additional material was removed the space 70 would be so large that the applicator would not function properly. Under these circumstances the roll would have to be removed and replaced with a new roll. The worn rolls were no longer useable and would be discarded even through there was a large unused portion of material left on the roll.

To remedy this situation the applicator 24 has been provided with a container 55 that can be moved with respect to the applicator roll 50. This is accomplished by loosing the screw 65 that secures the container 55. The container 55 is then free to be moved in and out until the proper space 70 between the roll 50 and the container is achieved. Thus, as the roll 50 becomes smaller the container 55 is moved back making the overflow passageway 59 smaller until the proper setting is obtained. Of course if the roll 50 is made larger, as when a new roll is installed, the container 55 would be moved forward to accommodate the layer roll. Once the proper space 70 between the roll and container is established the screw 65 is tightened to lock the container in position against the guide strips.

To obtain the proper setting for space 70 it has been found that a gage can be used. The gage is as thick as the desired dimension of the space 70. The gage is inserted into the space 70 and the container 55 moved until it rest up against the gage. Then the screw 65 is tightened to secure the container in this position. When the gage is removed the space 70 between the roll 50 and the container 55 is at the desired dimension.

Without being able to reposition the container 55 it is very difficult to machine more than 3/64 of an inch off the roll 50 and still have space 70 to be of a proper size to prevent air flow into container 55. However, by repositioning container 55 the space 70 can be controlled so it remains within acceptable limits. Thus, more material can be machined from the roll 50 and the rolls can be used for a longer period of time. This in turn improves the economics of the applicator.

Figure 6:
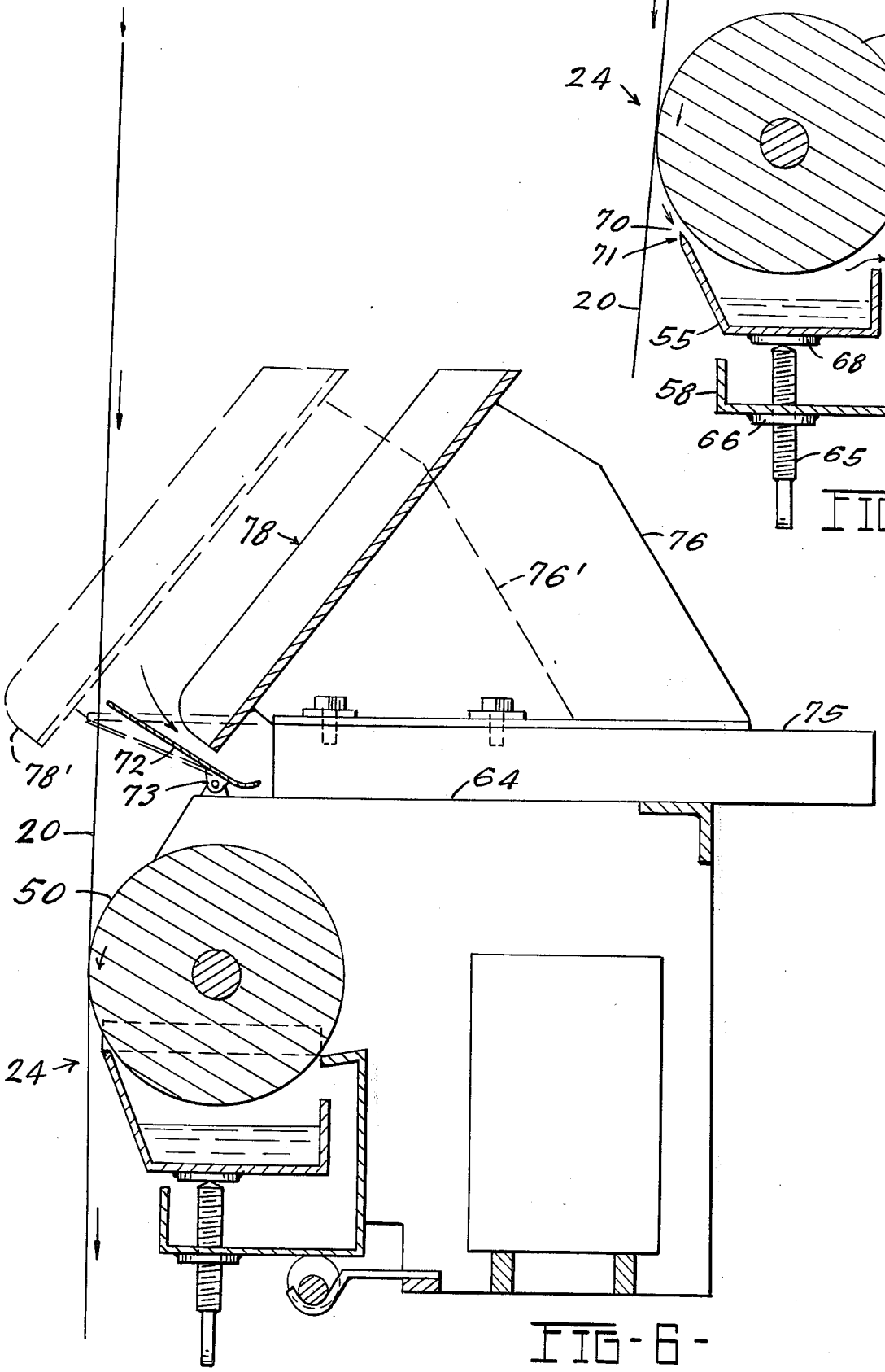
FIG. 6 is a side view of an applicator that incorporates an air diverting means.

FIG. 6 shows another applicator where an air diverter or deflector 72 has been added to the top of an applicator. When filaments 20 are being attenuated at high speeds there is a lot of air that is carried along with the filaments (see arrows in FIG. 6). This air travels along with the filaments until the applicator is reached. The applicator tends to block the flow of the entrained air. This causes a great deal of turbulence in the area where the liquid material is applied to the filaments. The turbulent air flow created can even blow the liquid coating material of the filaments 20 and the applicator roll 50. In any event the entrained air has a tendency to disrupt the coating operation.

An air diverter 72 can be used to help deal with the problems associated with the entrained air. The air diverter 72 is pivotally mounted on support 73 which is positioned on support frame 64. One end of the diverter 72 is positioned immediately adjacent to the advancing filaments 20. In this position the edge of the air diverter protrudes into the air stream being carried along with the filaments 20 and diverts a major portion of the entrained air away from the filaments. The diverted air passes along the top of the applicator 24 through the passageway formed by support member 75. The diverted air is discharged into the area behind the applicator 24 where it has no effect on the coating of the filaments. Although the air diverter 72 does not remove all the entrained air it removes a substantial portion of it and helps to reduce disruptive turbulence in the filament coating area.

Above the air diverter 72 there is a member 76 that is movably mounted on support member 75. Attached to the member 76 is drip shield 78. When the applicator 24 is not in operation the member 76 and drip shield 78 can be moved forward so they extend out over the applicator roll 50. Dashed lines 76' and 78' show the location of the member and drip shield when they have been moved forward over the applicator roll 50. As the air diverter 72 is pivotally mounted it can be moved to allow the drip shield 78 to be moved forward. In the forward location the drip shield 78' is in position to divert away from the applicator roll 50 molten glass and other foreign material that might drip from the shut down bushings. Thus, when the drip shield 78 is in the forward position it acts to protect the applicator 24 when it is not being used to coat filaments.

Figure 7:
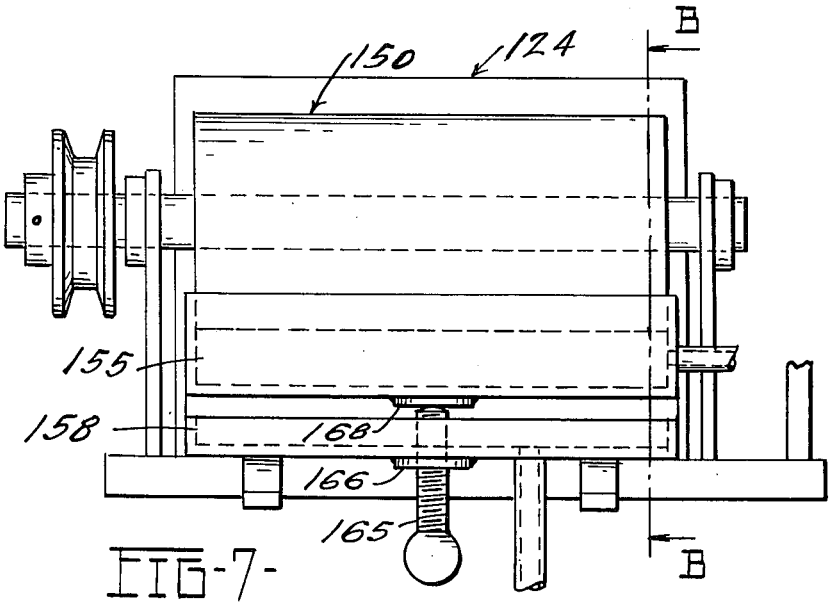
FIG. 7 is a front view showing another embodiment of a filament coating applicator.
Figure 8:
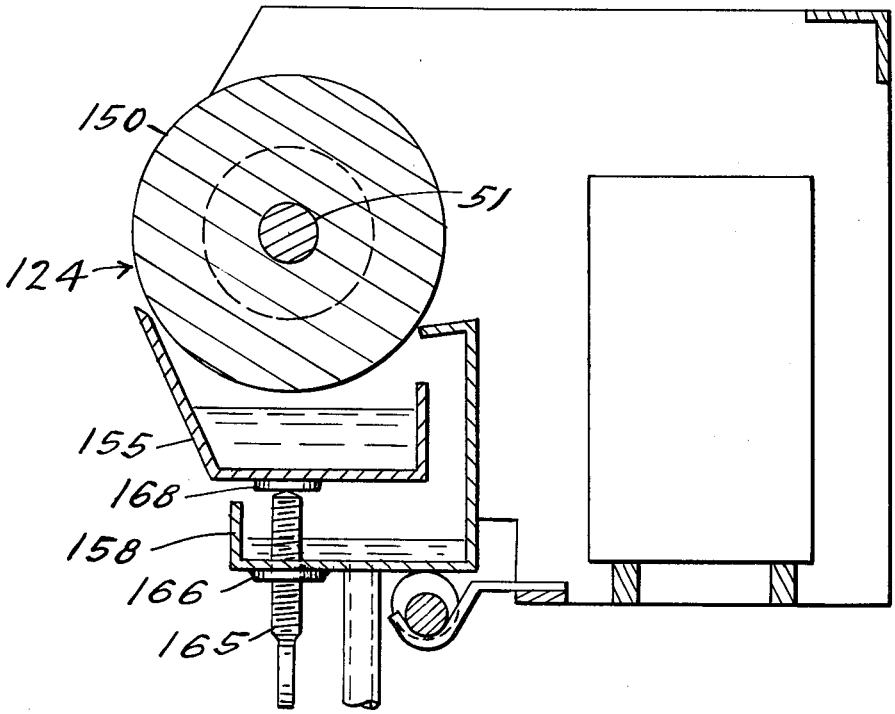
FIG. 8 is a cross section of the applicator in FIG. 7 taken along line BB.

FIGS. 7 and 8 show a applicator 124 that has a different method for repositioning the liquid supply container 155. Here the screw 165 passes through support plate 166, overflow container 158 and rest against the support plate 168 on the bottom of container 55. The screw 165 is rotatable and rotation of the screw causes it to move up or down. Since container 155 is supported by the end of screw 165 any movement of the screw results in movement of the container 155. When the applicator roll 150 becomes larger or smaller the screw 165 can be to move the container 155 so it is in proper position with respect to the applicator roll 150. Thus, this is another way to reposition the liquid supply container to maintain a desired spacing between the roll and the container when the diameter of the roll is changed.

Having described the invention in detail and with reference to particular material, it will be understood that such specifications are given for the sake of explanation. Various modifications and substitutes other than those cited may be made without departing from the scope of the invention as defined by the following claims.

We claim:

1. Apparatus for applying liquid to filaments comprising:

an open topped container for holding liquid to be applied to filaments, the sidewall of the container on the side of filament the sidewall of the container on the side of filament travel defining an upper edge at the opening of the container;

a rotatable mounted applicator member positioned proximate the opening to transfer liquid from the container to filaments passed across the member, the member being mounted with its surface in immediately adjacent spaced apart relationship to the upper edge of the open topped container on the side of filament travel, and, a screw having one end in contact with the container, the screw adapted to position the container with respect to the member so as to modify the spaced relationship between the upper edge of the container and the surface of the member to keep a sufficiently close spaced apart relationship to restrict air flow into the container from air movement caused by filament travel.

2. Apparatus of claim 1 wherein the applicator member rotates about a fixed horizontal axis.

3. Apparatus of claim 1 wherein the rotatable applicator member is rotated by a drive means.

4. Apparatus of claim 3 wherein the applicator member is rotated in the direction of travel of the filaments passed across the member.

5. Apparatus of claim 3 wherein the applicator member is rotated in a direction opposite to the direction of travel of the filaments passed across the member.

6. Apparatus of claim 1 wherein the applicator member is a cylindrical applicator roll.

7. Apparatus of claim 1 wherein the liquid applied to the filaments is a liquid sizing material.

8. Apparatus for applying liquids to filaments comprising:

an open topped container for holding liquid to be applied to filaments, the sidewall of the container on the side of filament travel defining an upper edge at the opening of the container;

an overflow container positioned so that excess liquid overflowing from the opening in the top of the container will be directed into the overflow container;

a rotatable applicator member positioned proximate to opening to transfer liquid from the open topped container to the filaments passed across the member, the member being mounted so that its surface is immediately adjacent the upper edge of the open topped container on the side of filament travel; and, a screw passing through the overflow container, one end of the screw being in contact with the lower surface of the open topped container, the screw adapted to position the open topped container with respect to the member so as to modify the spaced relationship between the upper edge of the container and the surface of the member to restrict air flow into the container from air movement caused by filament travel.

9. Apparatus of claim 8 wherein the overflow container is an open topped container.

10. Apparatus of claim 8 wherein the open topped container for holding liquid has an overflow passageway that connects to the overflow container.

* * * * *